US010905172B2

(12) United States Patent
Fontaine et al.

(10) Patent No.: US 10,905,172 B2
(45) Date of Patent: Feb. 2, 2021

(54) GARMENT

(71) Applicant: Blend or Bust Corporation, Los Angeles, CA (US)

(72) Inventors: Julie Fontaine, Santa Monica, CA (US); Cara Natterson, Los Angeles, CA (US)

(73) Assignee: Blend or Bust Corporation, Los Angeles, CA (US)

( * ) Notice: Subject to any disclaimer, the term of this patent is extended or adjusted under 35 U.S.C. 154(b) by 0 days.

(21) Appl. No.: 15/599,375

(22) Filed: May 18, 2017

(65) Prior Publication Data

US 2017/0332704 A1 Nov. 23, 2017

Related U.S. Application Data

(60) Provisional application No. 62/338,431, filed on May 18, 2016.

(51) Int. Cl.

| | |
|---|---|
| ***A41C 3/00*** | (2006.01) |
| ***A41B 9/06*** | (2006.01) |
| ***A41B 17/00*** | (2006.01) |
| ***A41B 1/08*** | (2006.01) |
| ***A41D 13/00*** | (2006.01) |
| ***A41D 7/00*** | (2006.01) |
| ***A41D 31/02*** | (2019.01) |
| ***A41F 15/00*** | (2006.01) |
| *A41C 3/14* | (2006.01) |

(52) U.S. Cl.

CPC ..... *A41B 17/00* (2013.01); *A41B 1/08* (2013.01); *A41B 9/06* (2013.01); *A41C 3/0057* (2013.01); *A41D 7/00* (2013.01); *A41D 13/0017* (2013.01); *A41D 31/02* (2013.01); *A41F 15/002* (2013.01); *A41C 3/142* (2013.01); *A41D 2400/38* (2013.01)

(58) Field of Classification Search

CPC ..... A41C 3/0057; A41C 3/0014; A41C 3/12; A41C 3/0028; A41C 5/00

See application file for complete search history.

(56) References Cited

U.S. PATENT DOCUMENTS 5,385,502 A * 1/1995 Moretz ..... A41B 9/004 2/73
6,755,717 B2 * 6/2004 Smith ..... A41C 3/0057 128/869

(Continued)

OTHER PUBLICATIONS

Hem, Merriam Webster, https://www.merriam-webster.com/dictionary/hem ; accessed Oct. 8, 2018. (Year: 2018).*

(Continued)

*Primary Examiner* — Robert H Muromoto, Jr.

(74) *Attorney, Agent, or Firm* — Buchalter, a professional corp.; Kari L. Barnes

(57) ABSTRACT

The undergarment may include a multi-panel front construction in order to minimize the prominence of breast buds, nipples, and even mature breast tissue without sports bra-like compression. The garments are uniquely designed to maximize comfort with their super-soft external material and to maximize self-esteem with their unique inner front panel. The interior front panel is constructed from a different material than the external layers.

21 Claims, 3 Drawing Sheets

(56) References Cited

U.S. PATENT DOCUMENTS

| | | | | |
|---|---|---|---|---|
| 7,435,155 | B2 * | 10/2008 | Reinisch | A41C 3/0028 450/59 |
| 10,004,279 | B2 * | 6/2018 | Carlton | A41D 31/185 |
| 10,603,161 | B2 * | 3/2020 | Horne | A61B 17/00 |
| 2006/0105672 | A1 * | 5/2006 | Donnelly | A41C 3/0057 450/3 |
| 2009/0255037 | A1 * | 10/2009 | Sandusky | F41H 5/0492 2/455 |
| 2011/0143634 | A1 * | 6/2011 | Sokolowski | A41C 3/0057 450/39 |
| 2014/0273740 | A1 * | 9/2014 | Scott | A41C 3/12 450/93 |
| 2014/0276485 | A1 * | 9/2014 | Grutman | A41B 9/12 604/308 |
| 2018/0035724 | A1 * | 2/2018 | Blibech | A41C 5/005 |
| 2018/0077972 | A1 * | 3/2018 | Hinnershitz | A41C 3/04 |

OTHER PUBLICATIONS

"Stitch." The Merriam-Webster.com Dictionary, Merriam-Webster Inc., https://www.merriam-webster.com/dictionary/stitch. Accessed Jan. 8, 2020. (Year: 2020).*

* cited by examiner

GARMENT

PRIORITY

This application claims priority to U.S. Application No. 62/338,431, filed May 18, 2016, which is incorporated by reference in its entirety into this application.

BACKGROUND

Today, girls are entering puberty 1-2 years earlier than they did a generation ago. One of the earliest changes is breast development: it is now typical for 8-year old girls to have breast buds and even developed breasts. In medicine, this shift in pubertal development is being called "the new normal." Full pubertal maturation is not happening any faster, however—the average age for first period remains 12.5 years, essentially unchanged over the past several decades. This means that puberty is starting earlier and proceeding more slowly than ever before.

Girls contend with body changes years before they age into garments designed to manage breasts. Perhaps more importantly, breast buds linger for much longer these days, and this stage of development results in awkward, tender, prominent starter-breast tissue and nipples that makes almost all girls feel embarrassed at some juncture. There exist no garments designed to address this issue.

Most starter bras, bralettes, and tween "half-tops" on the market either fail to conceal breast buds and nipples or they rely upon large circular pads inserted into the garment to cover the anatomy. Girls routinely complain that the thin garments don't "do" anything while the pads make them look bustier than they actually are. Both options make breast tissue or the garment itself plainly visible and unflattering under most tee shirts and tops. The only garments that effectively conceal breast buds and nipples are highly restrictive sports bras that use compressive materials and construction. There is no data about how these garments affect breast tissue development in the long run. There is also no data about skin rashes that appear as the result of local sweating, irritation, and possibly skin infection resulting from multi-hour wear of highly constrictive, non-breathable garments.

SUMMARY

Exemplary embodiments are disclosed herein for different styles of undergarments. Specifically, exemplary embodiments may be used as support for a juvenile's breast, such as for use as a bra. Different configurations may include a tee-strap, cross-strap, tank, kiss-strap, and combinations thereof. Exemplary embodiments may include a front three-panel, back two-panel construction. Exemplary embodiments may also use ultra-soft exterior material.

Exemplary embodiments of a garment using a novel 3-panel front construction and a 2-panel back construction may minimize the prominence of breast buds, nipples, and even mature breast tissue without sports bra-like compression. The bras are uniquely designed to maximize comfort with their super-soft external material and to maximize self esteem with their unique inner front panel.

DRAWINGS

DESCRIPTION

Exemplary embodiments of the undergarment is designed for maturing adolescents (ranging in age from prepubescence/age 6 through full development/age 18-20) to wear throughout the day for breast coverage. It uses an intermediate layer that facilitates the hiding of breast tissue at all stages of development. Exemplary embodiments may use a three-panel front construction and a two-panel back construction in order to minimize the prominence of breast buds, nipples, and even mature breast tissue without sports bra-like compression. Here, front is referring to the portion of the garment worn on the front of the body, while back is used to refer to the portion of the garment worn on the back of the body, and not to the front and back of the garment surfaces. The garments may be uniquely designed to maximize comfort with their super-soft external material and to maximize self-esteem with their unique inner front panel. The interior front panel is constructed from a different material than the external layers.

Figure 1:
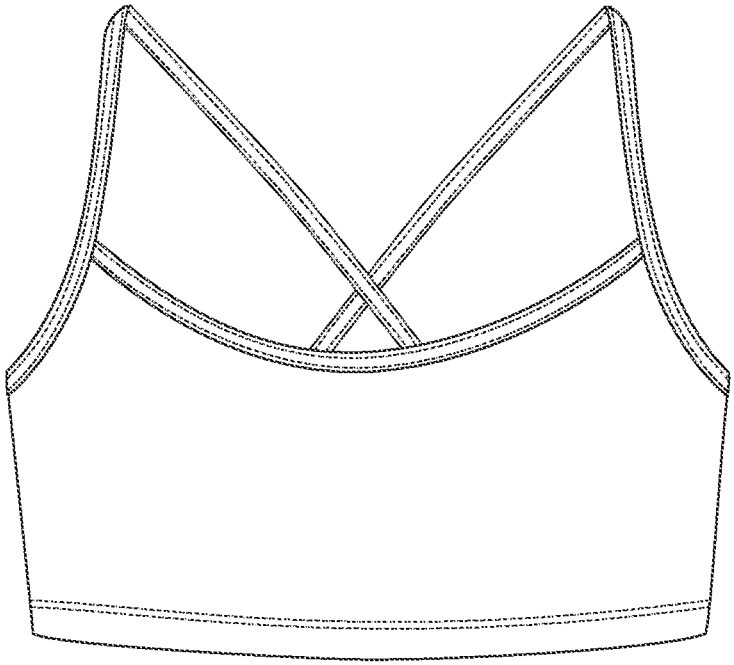
FIG. 1 illustrates an exemplary undergarment according to embodiments described herein.

An exemplary undergarment comprises a garment having a portion worn around the chest of a mature girl. The undergarment includes a front that is configured to be worn over at least the chest area and a back worn over the back of the girl. The front and back are attached, such as by sewing, integrated material, gluing, buttons, rivet, straps, or other means. As shown in exemplary FIG. 1, the garment creates a continuous circumferential material surface sized and shaped to fit around the chest of the girl (or any desired user). The front and back of the undergarment also include one or more straps to support the undergarment on the user.

Exemplary embodiments comprises a front section having a three layer fabric design to minimize the prominence of breast buds, nipples, and even mature breast tissue without sports bra-like compression.

Figure 2:
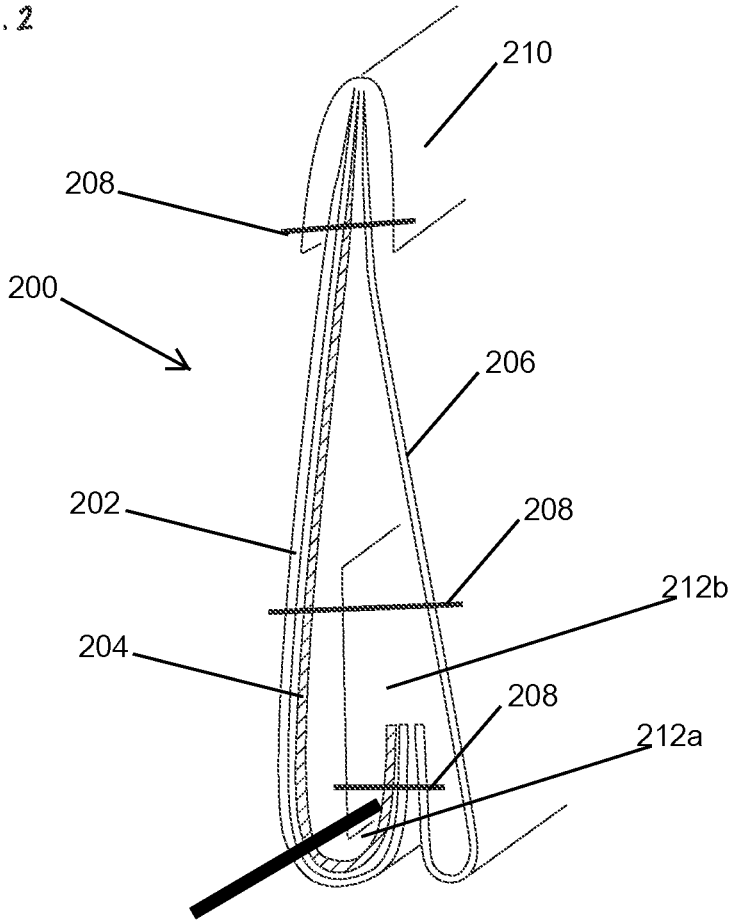
FIG. 2 illustrates a cross section, semi-exploded view of an undergarment according to embodiments described herein.

FIG. 2 illustrates an exemplary cut away vertical cross section of the front portion of the undergarment and exploded in a pre-manufactured configuration. As seen, the undergarment front portion 200 comprises at least three layers—an outer layer 202, intermediate layer 204, and inner layer 206. The outer layer 202 and inner layer 206 define outer surfaces of the undergarment. The outer layer 202 and inner layer 206 may be constructed of the same material such that the undergarment is reversible. The outer layer 202 and inner layer 206 may be in different colors such that the same garment may be used to provide different undergarment options when used in a normal or reversed configuration. For example, the inner layer 206 may have a white exterior surface, while the outer layer 202 may have a black exterior surface. Other selectable differences may also be available, such as color, texture, patterns, etc. The outer layer 202 and inner layer 206 may also be of different material to facilitate other functions as described herein. For example, the inner layer 206 may be selected for comfort and feel to the user, and therefore includes a softer material, while the outer layer 202 is selected for aesthetic reasons such as texture or color. The outer layer 202 may also be selected for other functional reasons, such as water resistance for swimwear, or sun protection for sport's wear.

As shown, the inner layer 206 and outer layer 202 are a soft spandex fabric. Outer layer 202 is, for example, 46% Cotton 45% Modal 9% Spandex, 4.10 oz/139 gsm. Outer fabric could be changed to other spandex or other fabrications that are stretchable. Other stretchable materials may include cotton, spandex, lycra, powerstretch fleece, knits, polyester, nylon, microfiber, and combinations thereof. In an exemplary embodiment, the inner layer 202 and/or outer layer 206 may have a 5-20% stretch factor, where stretch factor may be measured according to standard practice (e.g. as described here: http://stitch-n-smile.com/how-to-thursday-measuring-your-fabric-stretch/, which is incorporated by reference herein).

As shown, the intermediate layer has limited mechanical stretch. Intermediate layer 204 is, for example, 100% polyester Interlock Spacer, 6.20 oz, 210 gsm. However, other limited stretch materials may be used, such as, for example, simplex, duoplex, laminated foam, laminated fiberfill, double-knit, tricot, and combinations thereof. The intermediate layer 204 therefore has a stretch factor less than the outer layer 202 and/or the inner layer 206. In an exemplary embodiment, the intermediate layer 204 may have a stretch factor under 10%, or under 5%, or under the stretch factor of either the inner layer 206 and/or outer layer 202. Therefore, the intermediate layer comprises a different material, material configuration, and/or material composition from at least the outer layer 202 and/or the inner layer 206.

As shown, for example in FIG. 2, the front portion 200 may be constructed by cutting the desired combination of materials in approximately the same sized and shaped pattern. As used herein, approximately for the size and shape is in reference to normal tolerances used within the garment manufacturing industry. As the material edges are enclosed within seams or the interior of the garment, their exact alignment is not necessary. The resulting garment however, generally has co-extensive layers over the entire front portion, such as from the top of the garment to the bottom of the garment. The coextensive portion may be restricted to just the chest area. Therefore one or more layers may extended downward to cover a middle section of a user such that the undergarment is turned into a tank-top like configuration. Additionally layers may also be included over the top of the described three layers to achieve this same function of extending the garment to change the appearance from an undergarment to another garment type (such as sport shirt, tank top, swim wear, etc.) as described herein.

In an exemplary embodiment, during manufacturing the three layers are attached through a seam without the layers being in a pre-stretched configuration. In other words, each of the layers is in a relaxed, unbiased configuration, such that the layers are not under tension when shewn together. Therefore, the resulting three layer garment portion does not bunch or otherwise deform after manufactured and the layers maintain the same general shape, configuration, and relative position before and after attachment in the same relaxed, unbiased configuration.

The cut fabrics are then sewn together along peripheral edges at side seams. The top and/or bottom of the garment may include fold-over elastic sections 210. Seams 208 are shown along the perimeter of the garment to retain the layers together. An elastic band insert may also be used in place of or in addition to elastic sections 210. For example, elastic band may be incorporated in tunnel 212*a* between a material fold-over and a seam 208 or in tunnel 212*b* between seams 208.

Figure 3:
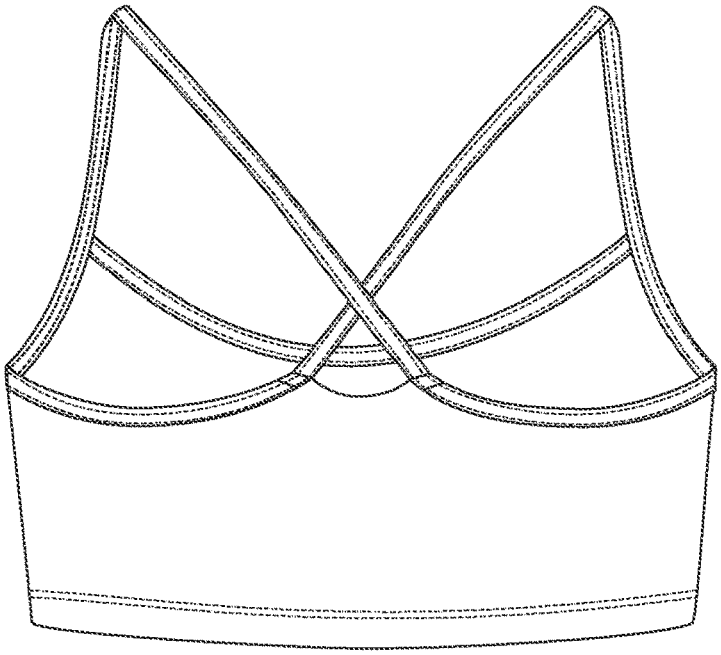
FIG. 3 illustrates an exemplary undergarment according to embodiments described herein.
Figure 4:
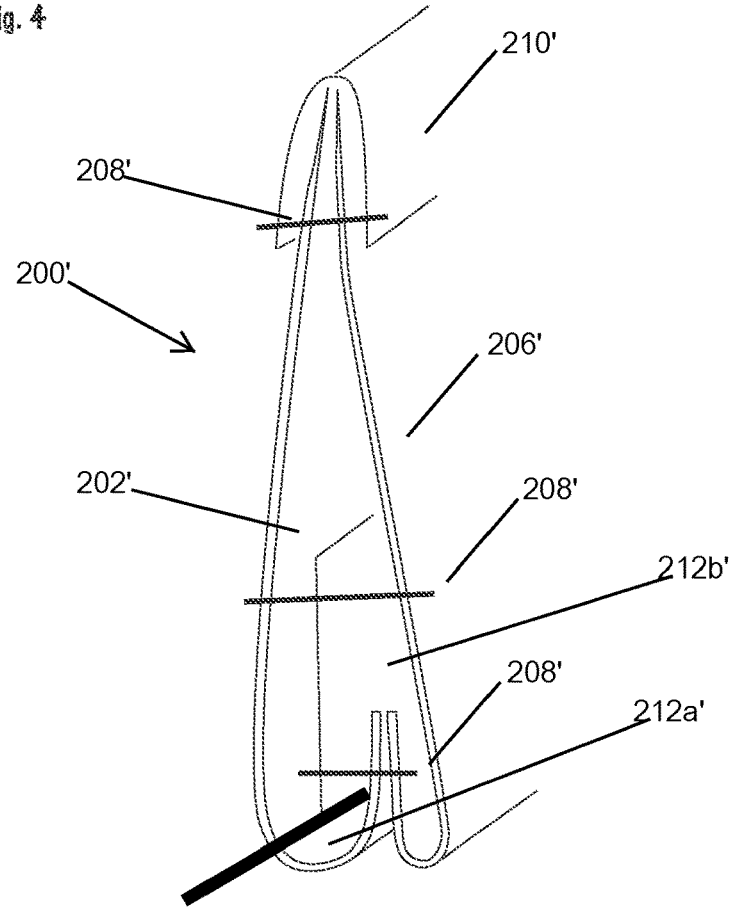
FIG. 4 illustrates a cross section, semi-exploded view of an undergarment according to embodiments described herein.
Figure 5:
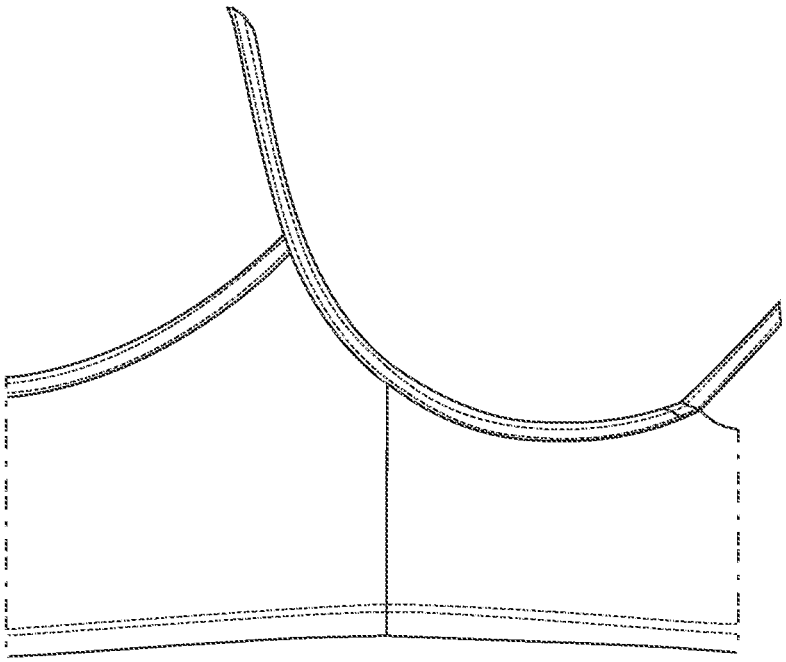
FIG. 5 illustrates an exemplary undergarment according to embodiments described herein.
Figure 6:
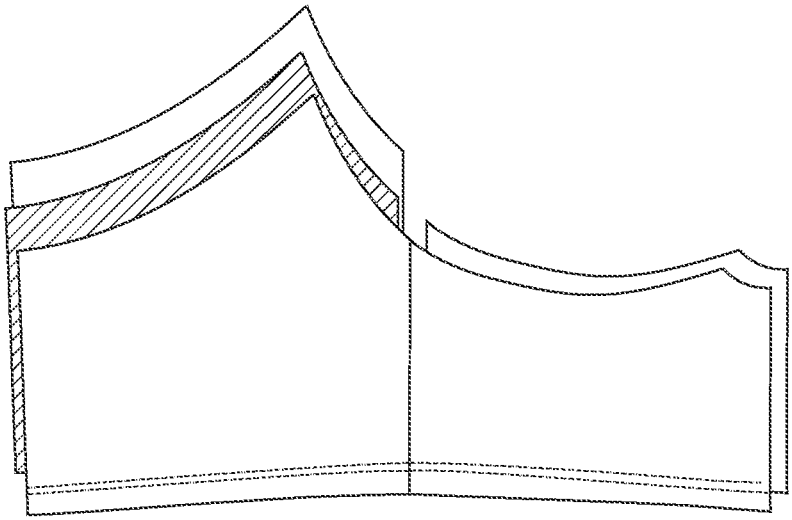
FIG. 6 illustrates an exemplary partial component view of an exemplary undergarment according to embodiments described herein.

FIG. 3 illustrates an exemplary embodiment of the undergarment as seen from the back. FIG. 4 illustrates an exemplary cut away cross section of the garment in an exploded, pre-sewn configuration.

In an exemplary embodiment, the outer layer 202' and inner layer 206' of the back portion define outer surfaces of the undergarment. The outer layer 202' and inner layer 206' may be constructed of the same material such that the undergarment is reversible. The outer layer 202' and inner layer 206' may be in different colors such that the same garment may be used to provide different undergarment options when used in a normal or reversed configuration. For example, the inner layer 206' may have a white exterior surface, while the outer layer 202' may have a black exterior surface. Other selectable differences may also be available, such as color, texture, patterns, etc. The outer layer 202' and inner layer 206' may also be of different material to facilitate other functions as described herein. For example, the inner layer 206 may be selected for comfort and feel to the user, and therefore includes a softer material, while the outer layer 202' is selected for aesthetic reasons such as texture or color. The outer layer 202 may also be selected for other functional reasons, such as water resistance for swimwear, or sun protection for sport's wear.

As shown, the inner layer 20'6 and outer layer 202' are a soft spandex fabric. Outer layer 202' is, for example, 46% Cotton 45% Modal 9% Spandex, 4.10 oz/139 gsm. Outer fabric could be changed to other spandex or other fabrications that are stretchable. Other stretchable materials may include cotton, spandex, lycra, powerstretch fleece, knits, polyester, nylon, microfiber, and combinations thereof. In an exemplary embodiment, the inner layer 202' and/or outer layer 206' may have a 5-20% stretch factor.

In an exemplary embodiment, the layers of the back portion are the same. The back portion material may be the same as outer layer 202 and/or inner layer 206 of the front portion 200. The outer layer of back portion may be the same as the outer layer of front portion, and inner layer of back portion may be the same as the inner layer of front portion. The inner and outer layers of the front and back portions may therefore be extensions of the same material pieces, or may be separate pieces sewn or otherwise attached together. The layers of the back portion are, for example, the same 46% cotton 45% Modal 9% spandex, 4.10 oz/139 gsm fabric used for the outer layers of the undergarment front portion. Similar to the front layers, these layers may be changed to other spandex, or stretchable fabrications as described above.

Similar to the construction of the front portion, the back layers may be cut into the back panel shape. The back layers may be approximately the same, such that when assembled the layers are coextensive along the back portion. Similar to the front portion, one layer may be extended or layers may be added to reconfigure the garment into other designs. One or two side seams may be used to couple the front and back sections.

In an exemplary embodiment, during manufacturing the two layers are attached through a seam without the layers being in a pre-stretched configuration. In other words, each of the layers is in a relaxed, unbiased configuration, such that the layers are not under tension when shewn together. Therefore, the resulting layered garment portion does not bunch or otherwise deform after manufacture and the layers maintain the same general shape, configuration, and relative position before and after attachment in the same relaxed, unbiased configuration.

Exemplary embodiments of the back design/shape can change. The exemplary back layers can be sewn into racer-back, tee back, or other designs. Construction at side seams, elastic at top and bottom band can be as described above with respect to the front portion. Therefore, as illustrated in the appended drawings, back portion 200' references the same numbers as used for the front portion 200 except with the inclusion of the apostrophe. These reference numbers may be configured as described for the front portion, except the shape may change to accommodate its position across the user's back instead of chest.

As shown, shoulder straps attach the front portion to the back portion of the garment. This straps are configured to rest on the user's shoulders. Straps may be made as an extension of the elastic band material used for the garment seam, may be an extension of one or more layers of the garment, or may be of another material or attachment. The straps may be removed entirely to create a strapless halter configuration. As shown, such as in FIG. 3, the straps may cross such that a terminal end of one strap attaches on a first side of the garment on the front portion with the opposing terminal end of the one strap attaching on a second side of the garment on the back portion. Similarly, a terminal end of a second strap attached on the second side of the garment on the front portion and the opposing terminal end of the second strap attaching on the first side of the garment on the back portion, such that the first and second straps cross when viewed from the front or back. As shown, the attachment of the first and second straps to the back portion may be closer to the center of the back portion, while the attachment to the front portion may be closer to the lateral sides of the garment. Other strap configurations are also within the scope of the disclosure. For example, the straps may not cross and remain on the same lateral sides of the garment, such that both terminal ends of a strap attach to the front and back portions, respectively, on the same lateral side of the garment. This strap configuration may approximate the cross-strapped embodiment by attaching the first strap to the second strap along its length away from the terminal ends. The attachment may be configurable, such as by a movable sleeve, clip, or hook, or may be static, such as by sewing. The straps may also merge or attach along their lengths such that first and second ends attach to the front portion on opposing lateral sides and come together in the back to attach to the back portion at a single location.

Exemplary embodiments are generally described herein in terms of a three layer design. However, the same objective can be achieved with 2 or more layers. Specifically, layers may be added for one or more purposes described herein or for other purposes, such as water resistance, sun protection, aesthetic appearance, moisture control, temperature regulation, etc. Layers may also be integrated and combined such that the benefits described herein for two or more layers may be achieved with a single layer. Layers may also be separated into one or more other layers. Layers may also be removed as dictated by the application. Therefore, any combination of layers may be used to perform any combination of functions described herein to obtain any of the benefits described herein or any other benefit provided thereby. For example, an inner non-stretchable layer may be sufficiently soft for contact with the skin, with an outer stretchable compressive layer to act to hide the breast and nipple contour.

Embodiments described herein are generally in the form of "undergarment", "bra", tee-top", among others. These terms are not intended to be limiting, but only exemplary. The present concept may be adapted for any garment configuration. Therefore, it may be used directly as a tank-top, t-shirt, sports bra, undergarment, bra, halter top, sports shirt, bralettes, tween "half-tops", swimwear, sport's wear, etc., any of which are generally referred to herein as "garment". Similarly, the description is generally directed at young women and girls that are around puberty and obtaining breasts and prominent nipples. However, the invention is not so limited and can be used by women of any age, and persons of any gender. Embodiments described herein may be used to protect, cover, and/or conceal the breast area and nipples of any user.

The invention claimed is:

1. A garment for use by girls having juvenile breasts in development to minimize a prominence of the breast buds with reduced compression, comprising:

a front portion to be worn over a user's chest, the front portion comprising:
an inner layer,
an outer layer,
and an intermediate layer between the inner layer and outer layer, wherein the intermediate layer comprises a fabric having a stretch factor less than the inner layer and the outer layer of the front portion;

a back portion to be worn over the user's back, the back portion comprising:
a back inner layer as the inner most layer, and
a back outer layer as the outer most layer and positioned over the back inner layer and in direct contact with the back inner layer;

wherein the inner layer, outer layer, and intermediate layer of the front portion are sewn together when the inner layer, outer layer, and intermediate layer are relaxed and unbiased such that the layers are not under tension when sewn.

2. The garment of claim 1, wherein the intermediate layer has a stretch factor of less than 10%.

3. The garment of claim 2, wherein the inner layer and back inner layer are stretchable having a stretch factor of 5-20%.

4. The garment of claim 2, wherein the inner layer, outer layer, and intermediate layer are coextensive over an entire area of the front panel.

5. The garment of claim 4, wherein the front portion is shaped and configured to extend across the user's chest from opposing body sides from a position above the user's nipples to a position below the user's breast.

6. The garment of claim 3, further comprising straps extending from the front portion to the back portion, wherein the straps cross at the back of the user, such that a strap from a first side of the front portion extends to a corresponding opposite side of the back portion, wherein the first side and the corresponding opposite side are on opposite sides of the user's body when worn.

7. The garment of claim 3, further comprising straps extending from the front portion to the back portion, wherein the straps do not cross, and a first strap positioned on a first side of the front portion extends to a corresponding first side of the back portion and a second strap is positioned on a second side of the front portion and extends to a corresponding second side of the back portion, wherein the first side and corresponding first side are on the same side of a user's body when worn and the second side and corresponding second side are on the opposite side of the user's body when worn.

8. The garment of claim 3, further comprising straps extending from the front portion to the back portion, wherein the inner layer, intermediate layer, and outer layer are attached along a top seam with the inner layer, intermediate layer, and outer layer generally planar and a fold over seam material, separate from the inner layer, intermediate layer, and outer layer, is positioned on an outer surface of the outer layer and inner surface of the inner layer and the fold over seam material, outer layer, intermediate layer, and inner layer are all directly sewn together.

9. The garment of claim 8, wherein a bottom portion of the inner layer and intermediate layer are folded over in a first direction, and a bottom portion of the outer layer is folded over in an opposing direction such that the terminal ends of the layers are toward each other within the garment between the inner layer and outer layer, and the inner layer, intermediate layer, and outer layer are sewn together at a fold-over region of the layers.

10. The garment of claim 8, wherein the back inner layer, and back outer layer are attached along a top seam with the back inner layer, and back outer layer generally planar and a fold over seam material, separate from the back inner layer and back outer layer, is positioned on an outer surface of the back outer layer and inner surface of the back inner layer and the fold over seam material, back outer layer, and back inner layer are all directly sewn together.

11. The garment of claim 10, wherein a bottom portion of the back inner layer is folded over in a first direction, and a bottom portion of the back outer layer is folded over in an opposing direction such that the terminal ends of the layers are toward each other within the garment between the back inner layer and back outer layer, and the back inner layer, and back outer layer are sewn together at a fold-over region of the layers.

12. The garment of claim 8, further comprising an elastic material within a bottom portion of the garment between the inner layer and outer layer.

13. The garment of claim 3, further comprising a second outer layer over the inner layer, intermediate layer, and outer layer, wherein the second outer layer comprises a different material than the inner layer and outer layer.

14. The garment of claim 3, wherein the garment is configured as a tee-top, undergarment, tank-top, t-shirt, sports bra, undergarment, bra, halter top, sports shirt, bralette, tween "half-top", swimwear, sport's wear, or combination thereof.

15. The garment of claim 10, wherein the front portion is sewn to the back portion at two side seams.

16. The garment of claim 15, wherein a continuous fold over seam material extends from the back portion to the front portion across the side seam.

17. The garment of claim 16, wherein the continuous fold over seam continuously and integrally extends from the layers to define the straps extending from the front portion to the back portion.

18. The garment of claim 17, wherein the fold over seam material separates from the back portion to extend away from the back portion to define the straps and separate from the front portion to extend away from the front portion to define the straps, a second fold over seam material positioned along a second top seam with the inner layer, intermediate layer, and outer layer generally planar and the second fold over seam material, separate from the inner layer, intermediate layer, and outer layer, is positioned on the outer surface of the outer layer and the inner surface of the inner layer and the second fold over seam material, outer layer, intermediate layer, and inner layer are all directly sewn together, where the second fold over seam material is positioned along a gap where the fold over seam material separates from the front portion.

19. A garment for use by a girl having juvenile breasts in development to minimize a prominence of the juvenile breasts with reduced compression, comprising:

a front portion to be worn over a user's chest, the front portion comprising:

an inner layer comprising an inner layer material having a stretch factor of 5 to 20 percent, an outer layer comprising an outer layer material combination having a stretch factor of 5 to 20 percent, wherein the inner layer and outer layer are configured to be reversible such that either the inner layer or the outer layer is configured to comfortably position against a kin of the girl, and an intermediate layer between the inner layer and outer layer, wherein the intermediate layer comprises an intermediate fabric having a stretch factor of less than 5 percent, the stretch factor of the intermediate layer uniform across the entire intermediate layer;

a back portion to be worn over the user's back, the back portion comprising:

a back inner layer as the inner most layer, and a back outer layer as the outer most layer and positioned over the back inner layer and in direct contact with the back inner layer;

a fold over seam material;

two straps; and an elastic material;

wherein the inner layer, intermediate layer, and outer layer are attached along a top seam with the inner layer, intermediate layer, and outer layer generally planar and the back inner layer and back outer layer are attached along a top seam with the back inner layer and back outer layer generally planar, the attachment along the top seam by a fold over seam material, separate from the inner layer, intermediate layer, outer layer, back inner layer and back outer layer such that the fold over seam material defines an edge and outermost inner and outer layer of the garment at the top seam and the folder over seam material sewn together, wherein the inner layer, outer layer, and intermediate layer of the front portion are sewn together when the inner layer, outer layer, and intermediate layer are relaxed and unbiased such that the layers are not under tension when shewn;

wherein the two straps are an extension of the fold over seam material separated from the inner layer and outer layer at a front of the garment and extensions of the fold over seam material separated from the back inner layer and back outer layer on the back of the garment, the two straps configured to extend over respective shoulders of a user when worn, wherein a bottom portion of the inner layer and intermediate layer are folded over in a first direction, and a bottom portion of the outer layer is folded over in an opposing direction such that the terminal ends of the layers are toward each other within the garment between the inner layer and outer layer, and the inner layer, intermediate layer, and outer layer are sewn together at a fold over region of the layers and the elastic material is positioned within the folded over region between the inner layer and outer layer.

20. The garment of claim 19, wherein the inner layer and outer layer comprise spandex and the intermediate layer comprises polyester, and the garment is configured to be reversible such that the inner layer is configured to be positioned against a skin or the outer layer is configured to be positioned against the skin.

21. A method of covering developing breast tissue without compression, comprising:

providing a garment, having:

a front portion to be worn over a user's chest, the front portion including:

an inner layer comprising an inner layer material having a stretch factor of 5 to 20 percent, an outer layer comprising an outer layer material combination having a stretch factor of 5 to 20 percent, and an intermediate layer between the inner layer and outer layer, wherein the intermediate layer comprises an intermediate fabric having a stretch factor of less than 5 percent, the stretch factor of the intermediate layer uniform across the entire intermediate layer, a back portion to be worn over the user's back, the back portion including:

a back inner layer as the inner most layer, and a back outer layer as the outer most layer and positioned over the back inner layer and in direct contact with the back inner layer, a fold over seam material, two straps, and an elastic material, wherein the inner layer, intermediate layer, and outer layer are attached along a top seam with the inner layer, intermediate layer, and outer layer generally planar and the back inner layer and back outer layer are attached along a top seam with the back inner layer and back outer layer generally planar, the attachment along the top seam by a fold over seam material, separate from the inner layer, intermediate layer, outer layer, back inner layer and back outer layer such that the fold over seam material defines an edge and outermost inner and outer layer of the garment at the top seam and the folder over seam material sewn together, wherein the inner layer, outer layer, and intermediate layer of the front portion are sewn together when the inner layer, outer layer, and intermediate layer are relaxed and unbiased such that the layers are not under tension when shewn, wherein the two straps are an extension of the fold over seam material separated from the inner layer and outer layer at a front of the garment and extensions of the fold over seam material separated from the back inner layer and back outer layer on the back of the garment, the two straps configured to extend over respective shoulders of a user when worn, wherein a bottom portion of the inner layer and intermediate layer are folded over in a first direction, and a bottom portion of the outer layer is folded over in an opposing direction such that the terminal ends of the layers are toward each other within the garment between the inner layer and outer layer, and the inner layer, intermediate layer, and outer layer are sewn together at a fold over region of the layers and the elastic material is positioned within the folded over region between the inner layer and outer layer;

positioning the garment on an upper body portion of a girl having developing breasts with the inner layer of the garment against a skin of the girl;

minimizing a prominence of the breast buds with reduced compression with the garment; and removing the garment and positioning the garment on an upper body portion of the girl having developing breasts with the outer layer of the garment against the skin of the girl.

* * * * *